US007861487B2

(12) United States Patent
Kufner et al.

(10) Patent No.: US 7,861,487 B2
(45) Date of Patent: Jan. 4, 2011

(54) TILE ALIGNMENT AND LEVELING DEVICE

(75) Inventors: Edward A. Kufner, Fairfield, IA (US); Michele Volponi, Keokuk, IA (US)

(73) Assignee: Davinci Italia/USA Group, LLC, Fairfield, IA (US)

( * ) Notice: Subject to any disclaimer, the term of this patent is extended or adjusted under 35 U.S.C. 154(b) by 0 days.

(21) Appl. No.: 12/467,783

(22) Filed: May 18, 2009

(65) Prior Publication Data

US 2010/0287868 A1 Nov. 18, 2010

(51) Int. Cl.
*E04F 21/18* (2006.01)

(52) U.S. Cl. ..... 52/749.11; 52/747.11; 52/126.7; 33/526

(58) Field of Classification Search ..... 52/98, 52/111, 125.4, 126.1, 126.7, 127.1, 127.12, 52/747.11, 749.11; 24/16 PB; 33/526, 527, 33/533, 613; 411/512
See application file for complete search history.

(56) References Cited

U.S. PATENT DOCUMENTS 3,511,001 A 5/1970 Morgan, Jr.
3,537,146 A * 11/1970 Caveney ..... 24/16 PB
4,286,497 A * 9/1981 Shamah ..... 411/342
4,397,124 A 8/1983 Redman
4,397,125 A * 8/1983 Gussler, Jr. ..... 52/127.3
4,503,654 A 3/1985 Cosentino
4,558,544 A 12/1985 Albrecht et al.
4,865,501 A * 9/1989 Ferris ..... 411/340
4,897,899 A * 2/1990 Shely et al. ..... 24/16 PB
5,000,890 A 3/1991 DiStefano
5,263,260 A 11/1993 Smith
5,288,534 A 2/1994 Tavshanjian
5,584,452 A * 12/1996 Koike ..... 248/74.3
5,601,261 A * 2/1997 Koike ..... 248/71
5,603,195 A 2/1997 Cosentino
5,607,256 A 3/1997 McCleary
5,674,942 A 10/1997 Hill et al.
5,675,942 A 10/1997 Crawford
5,832,619 A 11/1998 Volkema, Jr.
5,966,781 A 10/1999 Geiger
6,000,184 A 12/1999 Fernandes
6,347,435 B1 * 2/2002 Davignon et al. ..... 24/16 PB
6,412,185 B1 7/2002 Mills et al.
6,578,239 B2 * 6/2003 Hatch ..... 24/16 PB
6,625,951 B1 9/2003 McCarthy
6,658,703 B1 * 12/2003 Teagno et al. ..... 24/16 PB
6,704,972 B2 3/2004 Pyle (Continued)

OTHER PUBLICATIONS

Southwest Equipment Management, Inc., Tile Eze, Marble-Plane promotional literature.

*Primary Examiner*—Brian E Glessner
*Assistant Examiner*—James J Buckle, Jr.
(74) *Attorney, Agent, or Firm*—Ryan N. Carter

(57) ABSTRACT

A device for aligning and leveling tiles as they are laid in floors, walls, countertops, or the like. The device has a locking assembly and a bottom plate. The components are combined with a shaft that extends from the bottom plate through the locking assembly so that the locking assembly is movable along the length of the shaft. In use, the device is placed between adjacent tiles so that the locking assembly and bottom plate hold adjacent tiles at a desired height as the setting bed dries.

8 Claims, 9 Drawing Sheets

U.S. PATENT DOCUMENTS

| | | | | |
|---|---|---|---|---|
| 7,257,926 | B1 * | 8/2007 | Kirby et al. | 52/126.5 |
| 7,520,030 | B2 | 4/2009 | Laporte | |
| 2003/0177613 | A1 * | 9/2003 | Caveney et al. | 24/16 PB |
| 2006/0185269 | A1 | 8/2006 | Kufner et al. | |
| 2006/0185319 | A1 | 8/2006 | Kufner et al. | |
| 2008/0236094 | A1 * | 10/2008 | Doda | 52/749.11 |

* cited by examiner

TILE ALIGNMENT AND LEVELING DEVICE

BACKGROUND OF THE INVENTION

This invention is directed to the field of laying and leveling tile and slabs. More particularly, the invention is directed to a device for aligning and leveling adjacent tiles as they are laid in floors, walls, countertops, or the like.

Tile has become a popular decorative and functional article for use in floors, walls, countertops, and the like. Both professional tile installers and do-it-yourselfers spend a great deal of time aligning and leveling tiles as the tiles are being placed on a substrate's surface. Proper alignment and leveling of each tile is important for a number of reasons. One reason is that if one tile is improperly placed, the error will continue in adjacent tiles such that the installation will be unacceptable and the tiles will have to be replaced and/or ground and polished until the tiles are level or flat. In addition to aesthetic reasons for properly laying tile, a level surface is essential in tile floors so that people do not trip and fall on unevenly laid tiles. Replacing or otherwise correcting errors in tile installation takes time that adds to the total cost of the tile installation.

Laying and leveling tile can be difficult because many substrates are uneven, such as the ground substrate when laying tile for an outdoor patio. In this case, it can be difficult to raise the low areas of the substrate with mortar or other objects so that all the tiles are level. Further, tiles can shift and sink into mortar as the mortar dries. It has traditionally been necessary to continually monitor newly laid tiles as the mortar dries to ensure that the tiles remain level. Tile installers have used a variety of devices and methods to maintain quality the installation while completing the installation process as fast as possible. One basic method uses markings on the substrate surface. Marking the installation surface requires the mortar to be carefully applied such that the marks remain visible. Although this technique aids in the alignment of the tiles, it does not keep the tiles level as they are laid in the mortar. Further, the use of this marking technique increases the amount of time required for the installation which results in increased cost.

Another device used for laying and leveling tile is a frame designed to space tiles an appropriate distance. This type of frame is typically a fixed grid which is designed for a specific tile size. The disadvantage of this type of device is that it is a fixed size which requires a professional installer to carry multiple frames in order to be capable of installing various tile sizes. A further disadvantage of this type of frame is that it is only capable of installing one type of tile at a time.

Another device used to lay and align adjacent tiles is a spacer such as the one described in U.S. Pat. No. 6,625,951 (McCarthy). The spacer disclosed in this patent provides a square edge for properly aligning adjacent tiles at right angles, and a height adjustment means for adjusting the height of the tiles relative to the mortar surface. One problem with this device is that it is difficult to set multiple spacers to the same height which often results in an uneven tile surface. A related problem with this device is that the adjustment means does not allow the height of the tiles to be adjusted after the tile is laid because the height adjustment means is located under the tile after the tile is laid.

Therefore, there is a need for an efficient and inexpensive tile leveling and alignment device that allows for the vertical adjustment of tiles relative to each other after the tiles have been laid in the mortar.

SUMMARY OF THE INVENTION

The present invention is directed to a tile leveling and alignment device for use in installing tiles on substrates such as floors, walls, countertops, or the like. The invention comprises a locking assembly and a bottom plate. These components are combined with a shaft that extends from the bottom plate through the locking assembly so that the locking assembly is movable along the length of the shaft. A typical first step in laying tile is the application of a setting bed, such as a cement or mortar compound, to the substrate surface. Thereafter, the tiles can be placed in the setting bed. During these steps the bottom plate is positioned in the setting bed beneath the tiles so that the shaft extends upward between adjacent tiles. The bottom plate is preferably positioned so that it is in contact with more than one tile. The shaft extends from the bottom plate upward between adjacent tiles and is combined with the locking assembly. The locking assembly is movably combined with the shaft so that after the tiles are laid in the setting bed on top of the bottom plate, the locking assembly is moved toward the tiles until the tiles are between and in contact with the locking assembly and bottom plate. The plates support the tiles so that adjacent tiles remain level even if the substrate material is not level. In other words, the device keeps the tiles level relative to the adjacent tiles, not relative to the substrate surface. The device holds the tiles at the same height so that corners and/or edges of the adjacent tiles remain level in the setting bed as the setting bed dries and cures.

After the setting bed dries, thereby securing the tiles to the substrate, the shaft is separated from the bottom plate leaving the bottom plate beneath the set tiles. The locking assembly and the portion of the shaft above the separation point are released from the set tiles allowing the locking assembly to be reused in subsequent tile setting and leveling procedures.

One of ordinary skill in the art would understand that a plurality of tile leveling devices can be simultaneously used between different tiles being laid on a substrate so as to level many tiles at the same time.

DESCRIPTION OF THE PREFERRED EMBODIMENT OF THE INVENTION

Figure 2:
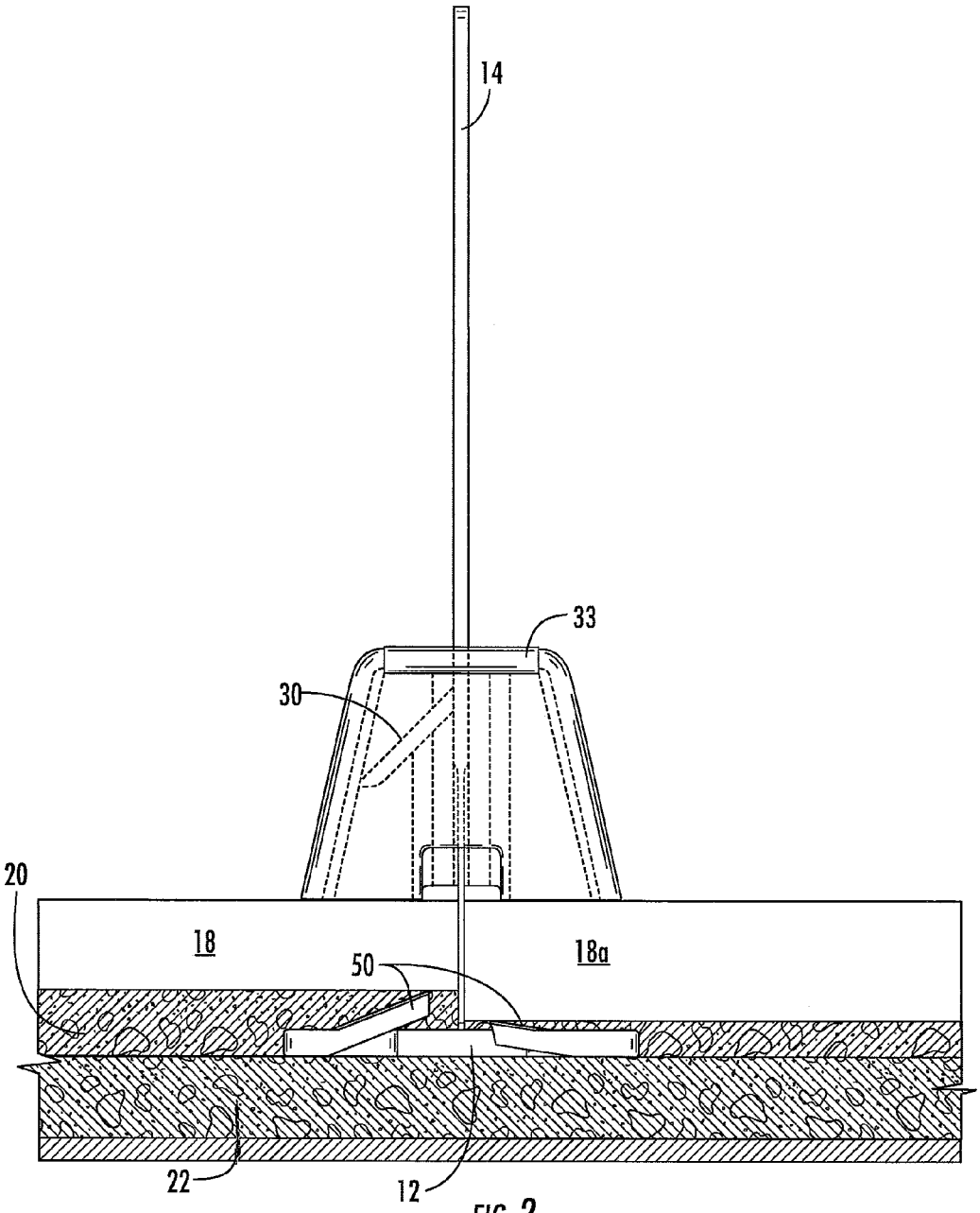
FIG. 2 is a side view of an embodiment of the device of the present invention in use between two adjacent tiles.

The present invention is a tile 18 alignment and leveling device. The device can be used to align and level tiles 18 that are being secured to any suitable substrate, including floors, walls, and countertops. It should be noted that words used in this specification such as upper, lower, top, and bottom, are relative to the device as it is shown in FIG. 2 with the locking assembly 33 above the bottom plate 12.

Figure 1:
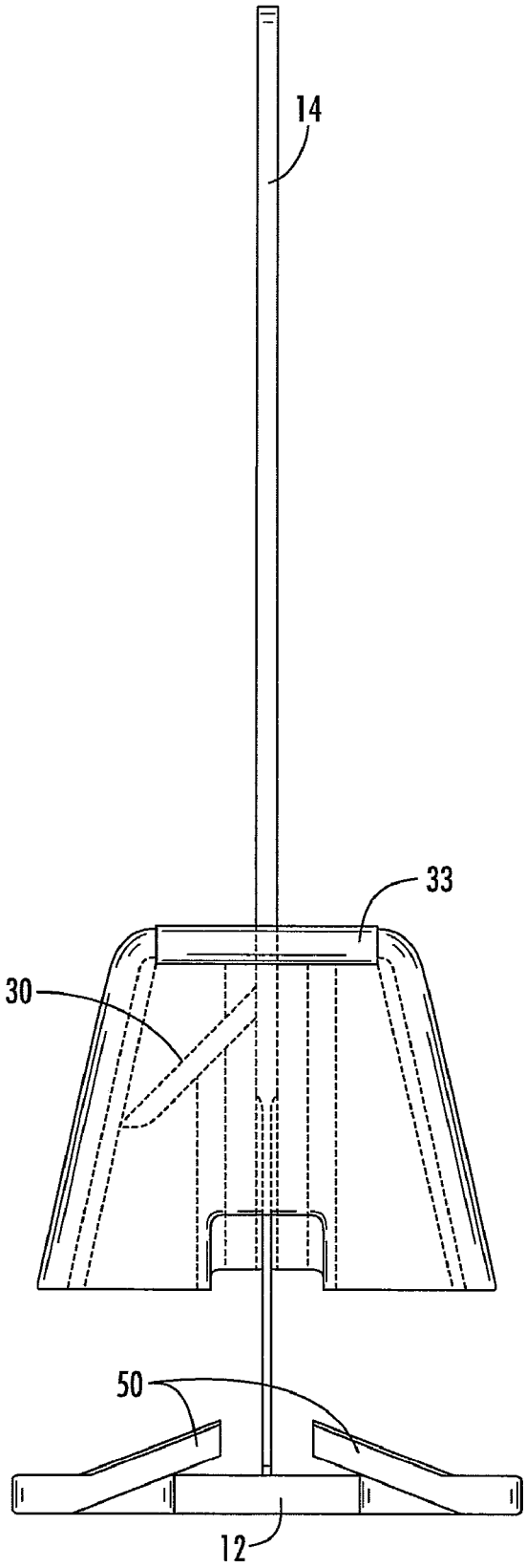
FIG. 1 is a side view of an embodiment of the device of the present invention.

As best seen in FIG. 1, the present invention comprises a locking assembly 33 and a bottom plate 12 combined with a shaft 14. The plate 12 can be made from any suitable material, however, it is preferably comprised of plastic or nylon with a metal reinforcing insert embedded inside. The metal insert provides strength and rigidity to the plate 12 that may be needed for leveling heavy tiles 18 or slabs, while the outer plastic (or nylon) portion prevents damage to the tiles 18 and does not rust. The shaft 14 is preferably comprised primarily of flexible nylon, thereby making the shaft 14 semi-rigid.

A typical first step in laying tile 18 is to apply a setting bed 20 such as mortar or cement to the substrate surface 22. After the setting bed 20 is applied, the tiles 18 can be placed in the setting bed 20. In use, the bottom plate 12 of the device is positioned in the setting bed 20 beneath the tiles 18 so that the shaft 14 extends upward between adjacent tiles 18, preferably at joint or corner locations. The shaft 14 extends from the bottom plate 12 upward between the tiles 18 and is combined with the locking assembly 33, which is positioned above the tiles 18. The locking assembly 33 is moved along the shaft 14 toward the tiles 18 until the tiles 18 are in contact with the locking assembly 33 and bottom plate 12 as shown in FIG. 2. The plate 12 and locking assembly 33 hold the tiles 18 at their desired height so that adjacent tiles 18 are level regardless of whether the underlying substrate material 22 is level. In other words, the bottom plate 12 does not need to rest on the substrate in order for the tiles 18 to be level. The bottom plate 12 may even be suspended above the substrate as long as at least a portion of the tile 18 is contacting the setting bed 20 and as long as the tiles 18 are level relative to each other. The plate 12 and locking assembly 33 hold the tiles 18 at the same height so that corners and/or edges of the adjacent tiles 18 remain aligned and level as the setting bed 20 hardens.

Figure 6:
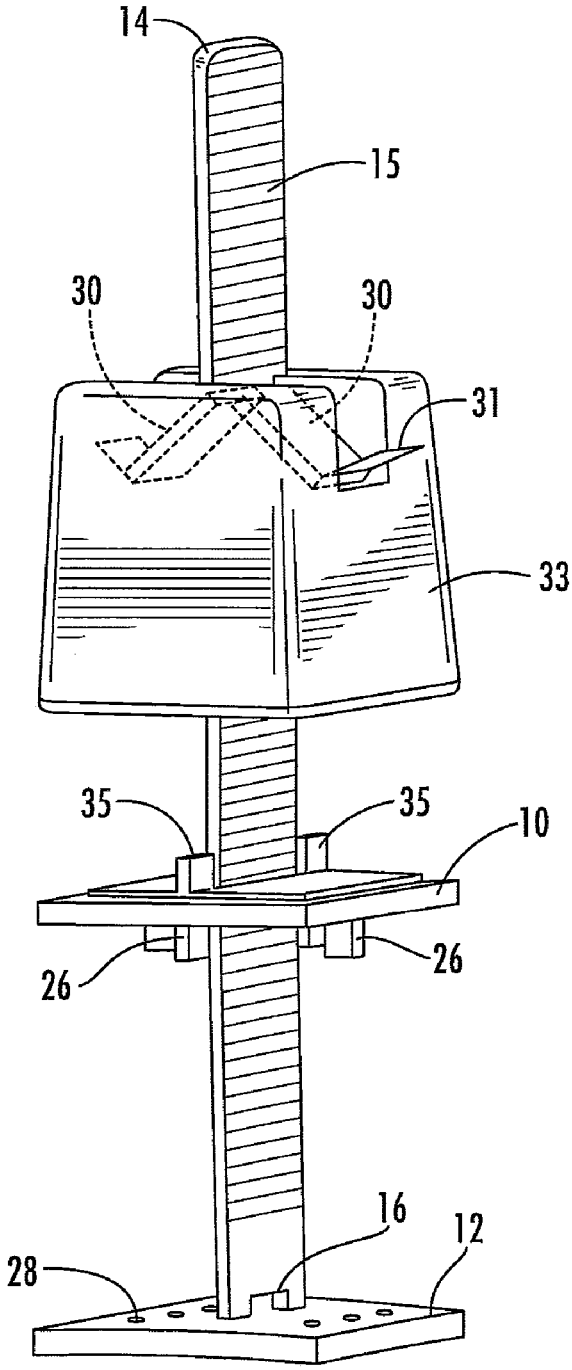
FIG. 6 is a perspective view showing an embodiment having a top plate that is separate from the locking assembly.
Figure 7:
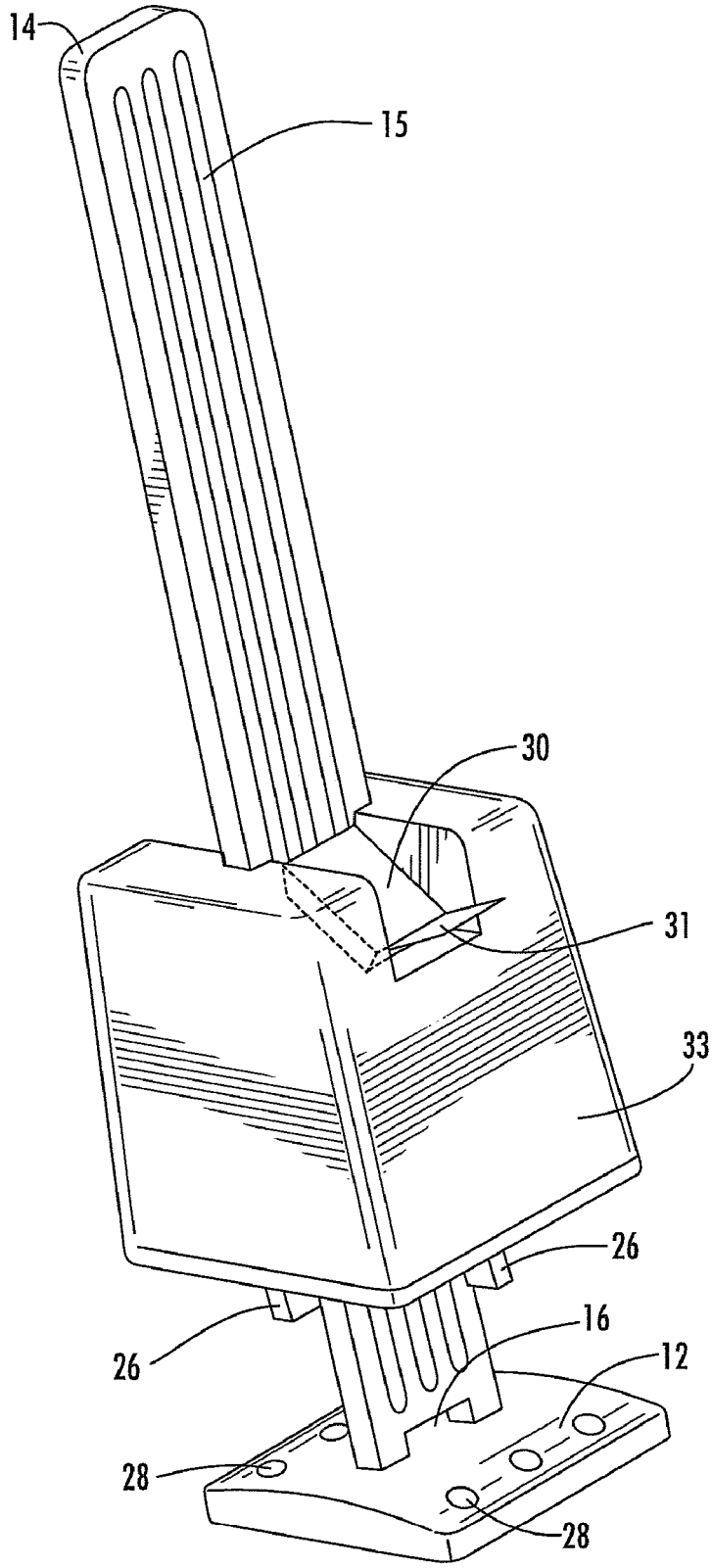
FIG. 7 is a perspective view of an embodiment having a top plate that is combined with the locking assembly.

Once the tiles 18 are properly positioned, the locking assembly 33 is secured in its place adjacent to the tiles 18 and prevented from moving upward along the shaft 14. Various embodiments of the locking assembly 33 are seen in FIGS. 1, 6, and 7. In some embodiments, the locking assembly 33 comprises at least one locking tongue 30 which, together with the shaft 14, functions like a commercially available "zip tie." In other words, the locking tongue 30 allows the locking assembly 33 to move freely in a first direction (downward) along the length of the shaft 14, but not in a second direction (upward) along the length of the shaft 14. The locking tongue(s) 30 of the locking assembly 33 are angled and adapted to interfere with the shaft 14 to allow movement in only one direction (downward).

As shown in FIG. 6, the locking tongues 30 may comprise a tongue release 31. Activation of the tongue release 31 enables the user to release the locking tongues 30 from the surface features 15 on the shaft 14 to allow movement of the locking assembly in the second (upward) direction.

FIG. 6 shows an alternate embodiment further comprising a top plate 10 which is separate from the locking assembly 33. In this embodiment, different top plates 10 having different sized fins 26 can be used with the same locking assembly 33. In this embodiment, locking assembly 33 preferably comprises members 35 which are received by openings (not shown) on the underside of locking assembly 33 to hold the locking assembly 33 together with the locking assembly 33 by an interference fit during use.

Figure 3:
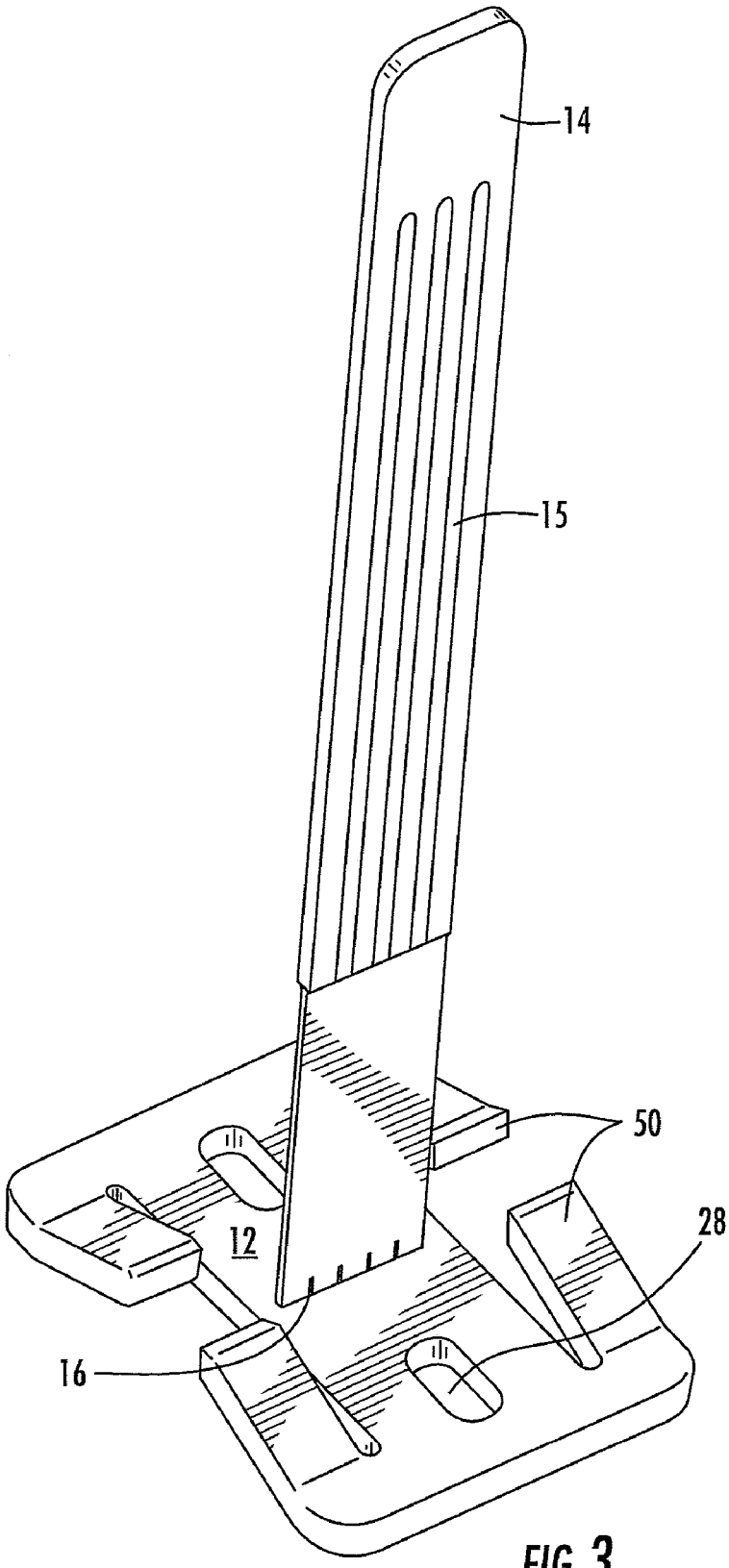
FIG. 3 is a perspective view of the embodiment shown in FIG. 1.

As seen best in FIGS. 3 and 7, the bottom plate 12 preferably comprises one or more openings 28. The openings 28 allow the setting bed material 20 to seep through the bottom plate 12. This seepage allows the setting bed material 20 to bond with the portion of the tile 18 directly above the bottom plate 12, which otherwise may not contact much of the setting bed material 20. Further, the seepage helps to ensure that the tiles 18 remain level as forces are applied to the plate 12, setting bed material 20, and/or tiles 18 during tightening, leveling, and setting. If the setting bed material 20 was not allowed to seep through the bottom plate 12, the setting bed material 20 could raise the bottom plate 12 as it dried which would consequently affect the level of the tiles 18.

Figure 8:
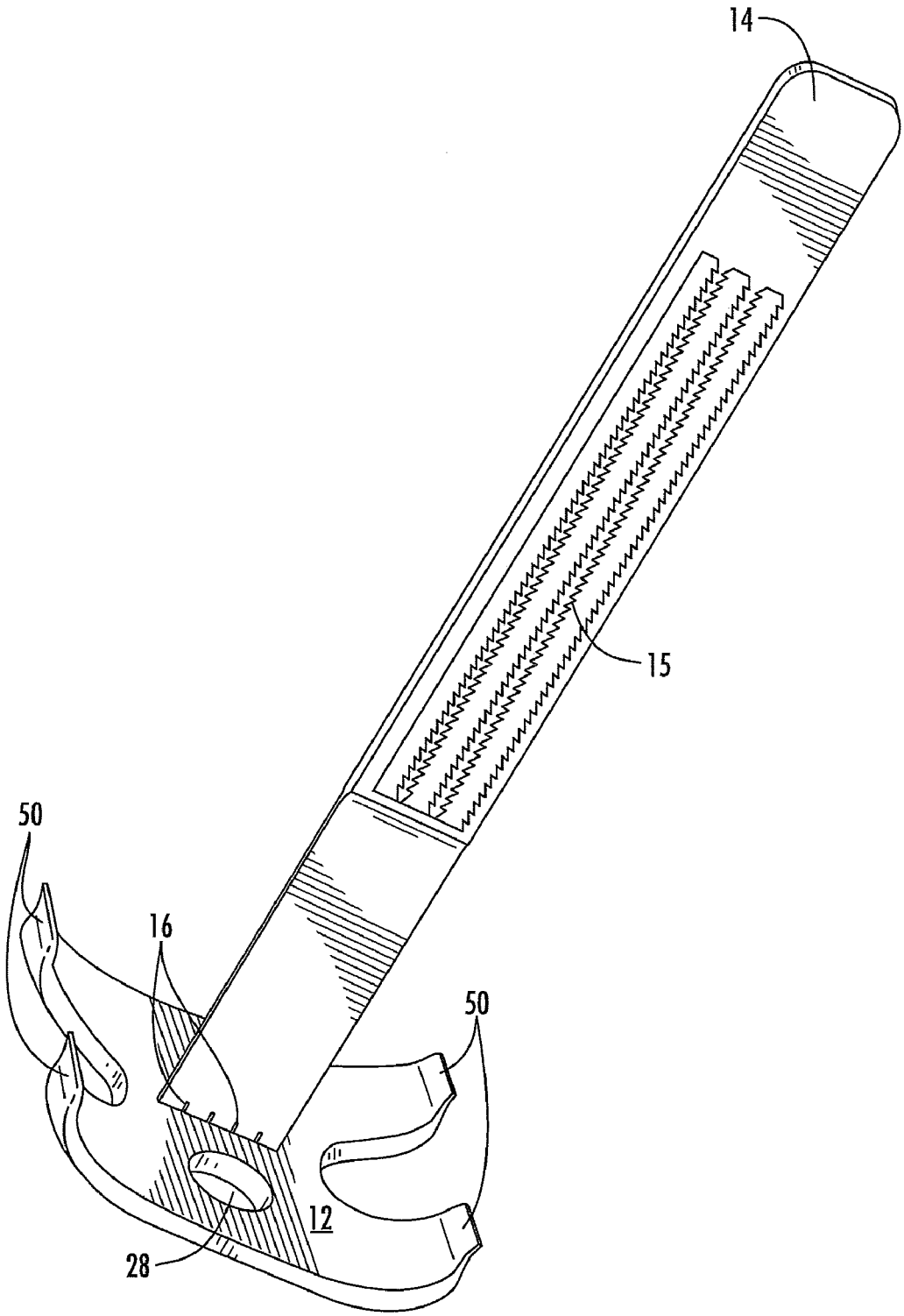
FIG. 8 is a perspective view of an embodiment similar to the embodiment shown in FIG. 1.
Figure 9:
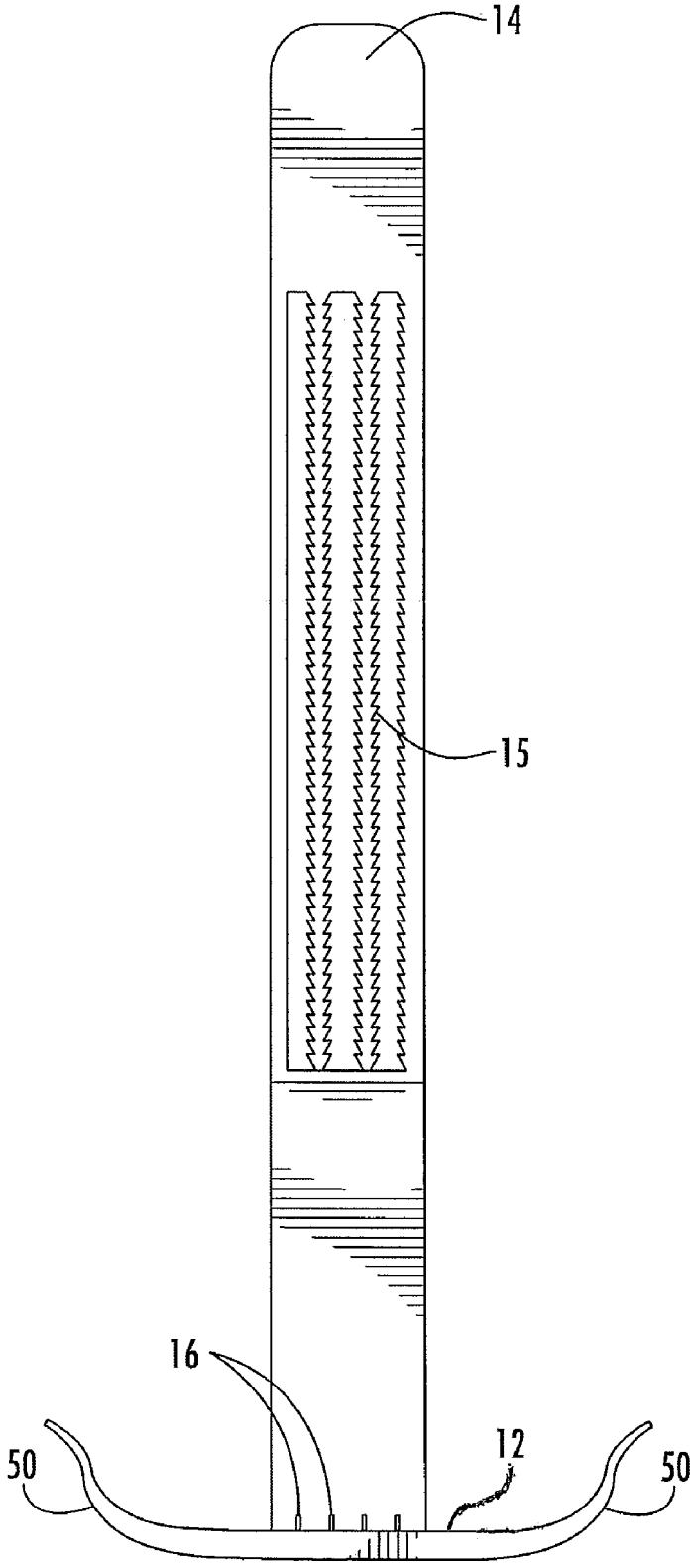
FIG. 9 is a side view of the embodiment shown in FIG. 8.

After the setting bed 20 dries, and the tiles 18 are secured to the substrate 22, the user removes the portion of the device that is visible above the laid tiles 18, i.e. the shaft 14 and locking assembly 33. In one embodiment, the shaft 14 comprises a separation point 16 near the connection of the shaft 14 and the bottom plate 12 as seen in FIGS. 6 and 8. The separation point 16 is structurally weaker than the remainder of the shaft 14 so that the user can apply force to the portion of the shaft 14 that extends above the tiles 18 and cause the shaft 14 to break at its separation point 16. In the embodiment shown in FIG. 6, the separation point 16 comprises a single opening which allows the separation point 16 to be structurally weaker and separate when the proper force is applied by the user. In the embodiment shown in FIG. 8, the separation point 16 comprises a plurality of micro holes or perforations which allow the separation point 16 to be structurally weaker and separate when the proper force is applied by the user. In one embodiment, the curing process of the setting bed 20 pulls moisture out of the shaft 14 making it more brittle. This makes it easier for the user to break the shaft 14 at the separation point 16. Once separated at the separation point 16, the bottom plate 12 remains below the tiles 18 and is therefore not reusable. The locking assembly 33, however, can be removed from the shaft 14 and reused in subsequent tile 18 laying operations. As discussed above, the shaft 14 is preferably made of a semi-rigid nylon. This semi-rigid material allow the shaft 14 to more easily be broken at its separation point 16.

FIGS. 1-3 and 8 show an embodiment wherein at least a portion of the bottom plate 12 is comprised of a material that has a flexible or spring-like quality, such as a plastic composite. The flexible portion 50 of the bottom plate 12 can move between a compressed position and an extended position. The flexible portion 50 of the bottom plate 12 is biased in its extended position. As shown in FIG. 8, the flexible portion 50 of the bottom plate 12 may be tapered so that it is thinner at its outer end to allow the device to be easily inserted under tiles 18.

As seen in FIG. 2, this embodiment is useful in situations where adjacent tiles 18, 18*a* have different thicknesses. The flexible portion 50 of the bottom plate 12 can be compressed under the weight of the thicker (heavier) tile 18*a*, while the flexible or spring-like quality of the bottom plate 12 can remain in its extended position under the thinner (lighter) tile 18 thereby holding the two adjacent tiles 18, 18*a* at the same elevation. In the manner, the tile alignment and leveling device is self-adjusting after it has been placed under the tiles 18, 18*a*. When the device is used at the intersection of four tiles 18, each of the four flexible portions 50 can be positioned under each of the four tiles 18 to independently hold each tile 18 at the same elevation. Although this embodiment is shown in FIGS. 3 and 8 as having four flexible portions ("wings"), the flexible portion 50 can be any other suitable shape with any suitable number of wings.

In the embodiment shown in FIG. 8, each flexible portion 50 begins near the center of the bottom plate 12 and extends upward and outward therefrom. In the embodiment shown in FIGS. 1-3, each flexible portion 50 begins near the outer corner of the bottom plate 12 and extends upward and inward.

Figure 4:
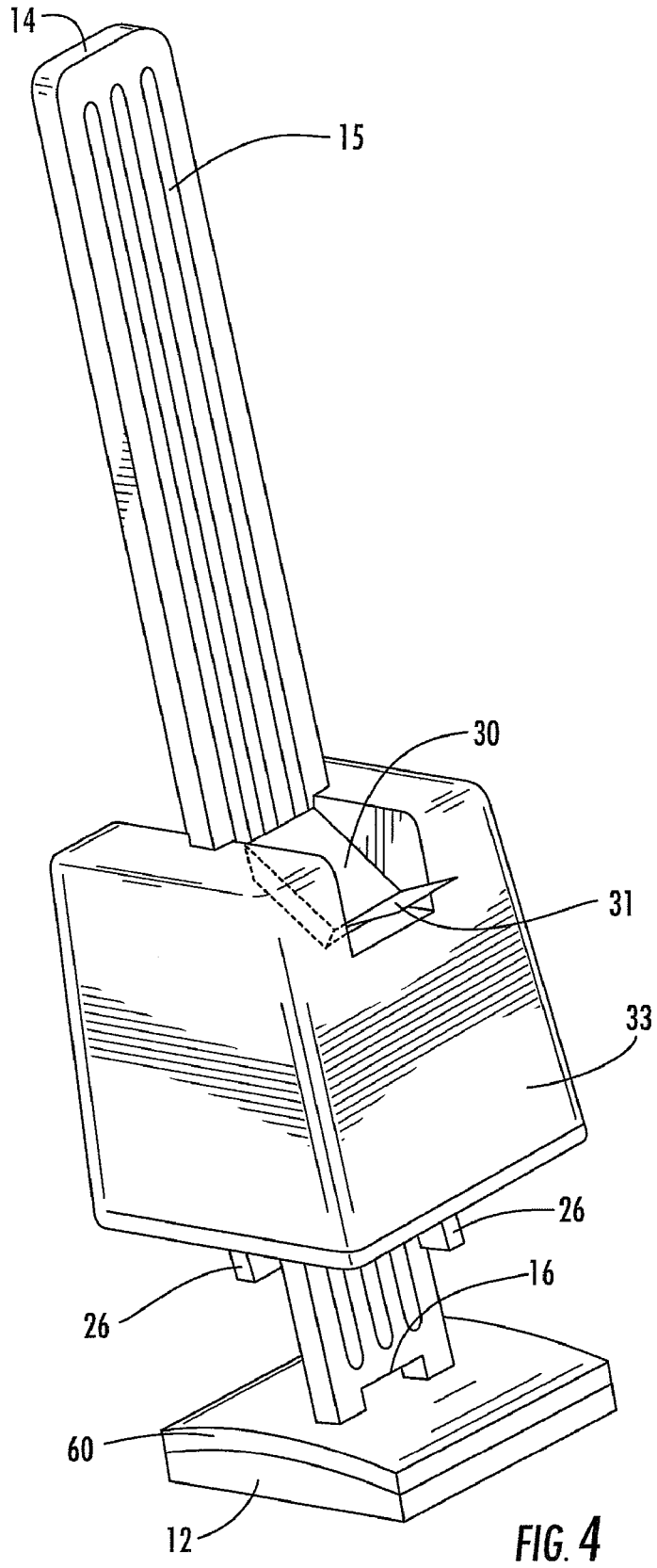
FIG. 4 is a perspective view of an embodiment using a resilient pad to assist with tile alignment.
Figure 5:
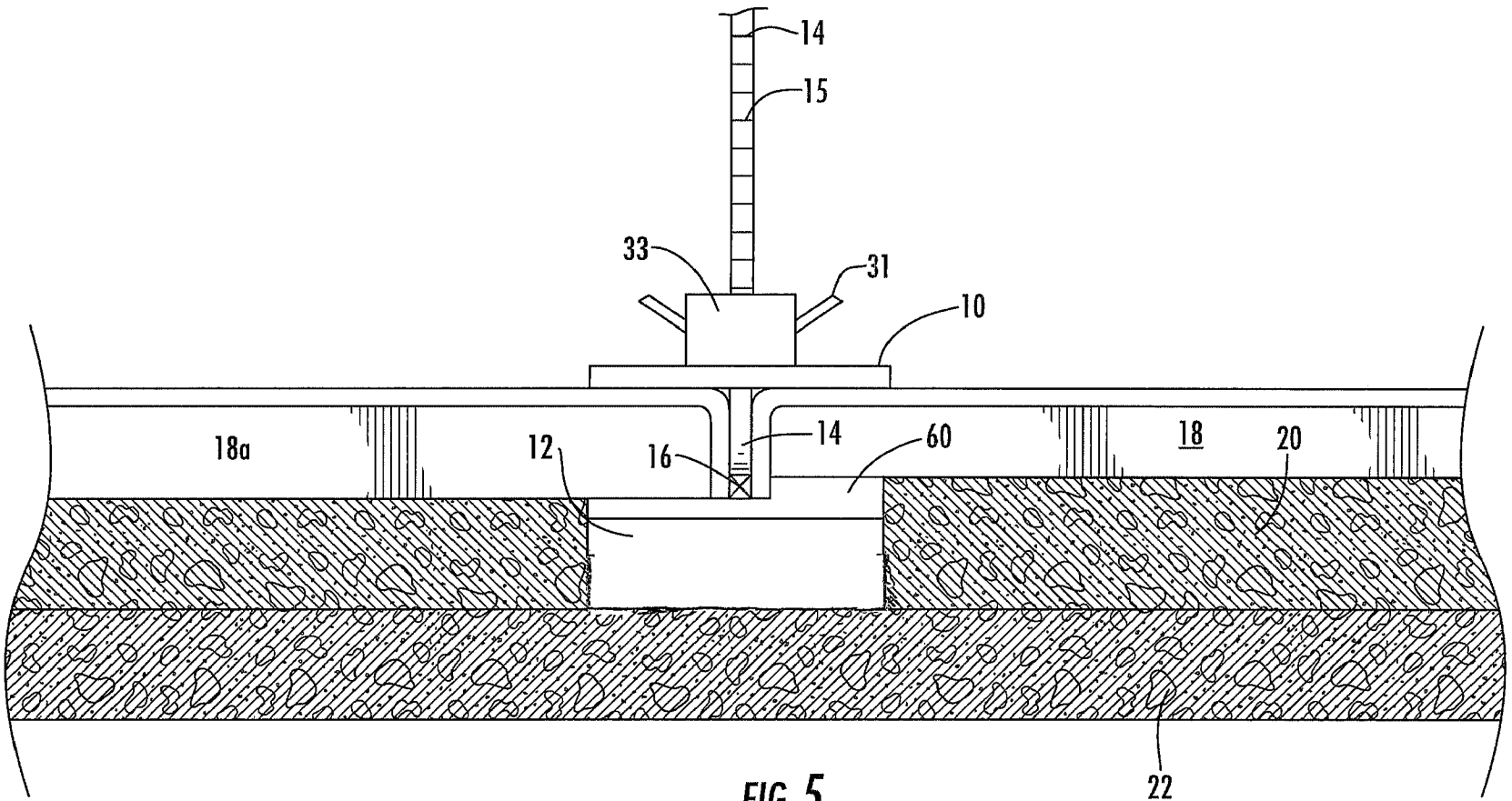
FIG. 5 is a side view of the embodiment shown in FIG. 4 in use between two adjacent tiles.

FIGS. 4 and 5 show an embodiment which comprises a resilient pad 60 adapted to be inserted between the tile 18 and the bottom plate 12. In one embodiment, the resilient pad 60 is a separate component from the bottom plate 12. In an alternate embodiment, the resilient pad 60 is secured to the bottom plate 12 during manufacture of the bottom plate 12. The resilient pad 60 has a flexible or spring-like quality and is made of a material such as a high-density resilient foam. The resiliency of the resilient pad 60 allows it to move between a compressed position and an extended position. The resilient pad 60 is biased in its extended position. As seen in FIG. 5, this embodiment is useful in situations where adjacent tiles 18, 18*a* have different thicknesses. After being positioned on the bottom plate 12 and placed under the tiles 18, 18*a*, the resilient pad 60 is compressed under the weight of the thicker (heavier) tile 18*a*, while it remains extended under the thinner (lighter) tile 18, thereby holding the two adjacent tiles 18, 18*a* at the same elevation.

As shown in FIG. 1, in some embodiments, some or all of the shaft 14 is made of a soft plastic or an elastic material that allows the shaft 14 to stretch longitudinally when force is applied. In use, the locking assembly 33 can be positioned against the tile 18 so that the shaft 14 is stretched thereby causing the locking assembly 33 and the tile 18 to be forced together by the resiliency of the shaft 14. At the same time, an upward force would be exerted on the tile 18 by the resilient pad 60 (if that embodiment were being used) or flexible portion 50 (if that embodiment were being used) thereby helping to secure and hold the tile 18 in the proper position.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is:

1. A device for laying and leveling tiles, said device comprising:

a bottom plate the having a corner, a center, a top surface, a bottom surface, and a flexible portion that extends upwardly above the top surface of the bottom plate and is movable between a compressed position and an extended position;

a shaft combined with and extending upwardly from the top surface of the bottom plate, said shaft having an upper portion, a lower portion, and a plurality of surface features; and a locking assembly having an opening which is adapted to receive the shaft, said locking assembly having an upper side and a lower side;

wherein the locking assembly has at least one locking tongue which is adapted to interfere with the surface features on the shaft so that the locking assembly is movable in a first direction along the shaft but not in a second direction along the shaft; wherein the flexible portion begins near the center of the bottom plate and extends outward away from the shaft.

2. The device of claim 1 wherein the flexible portion is biased in its extended position.

3. The device of claim 1 wherein the bottom plate further comprises four flexible portions.

4. The device of claim 1 wherein the locking assembly is movable in a first direction along the shaft but not in a second direction along the shaft.

5. The device of claim 1 wherein the shaft further comprises a separation point having a plurality of micro holes that make it structurally weaker than the remainder of the shaft to allow the shaft to be separated from the bottom plate.

6. The device of claim 1 wherein the bottom plate is tapered to be thinner at its edges for easy insertion under tiles.

7. The device of claim 1 wherein the shaft is resilient thereby allowing it to stretch longitudinally along its length from a first position to a second position, said shaft being biased in its first position.

8. A device for laying and leveling tiles, said device comprising:

a shaft having an upper portion and a lower portion;

a bottom plate having a corner, a top surface combined with the shaft, a bottom surface, and a flexible portion beginning near the corner of the bottom plate and extending upward above the top surface of the bottom plate and inward toward the shaft, the flexible portion is movable between a compressed position and an extended position;

a locking assembly having an opening adapted to receive the shaft, wherein the locking assembly has at least one locking tongue that interferes with the shaft so that the locking assembly is movable in a first direction along the shaft but not in a second direction along the shaft.

* * * * *